United States Patent [19]

Tani et al.

[11] Patent Number: 4,821,412

[45] Date of Patent: Apr. 18, 1989

[54] METHOD OF PRODUCTING AN ELECTRIC CONTACT

[75] Inventors: Tatsuhiro Tani; Masaaki Ishiguri; Rokuro Kikuchi; Akio Ohyama, all of Katsuta, Japan

[73] Assignee: Hitachi, Ltd., Tokyo, Japan

[21] Appl. No.: 749,763

[22] Filed: Jun. 28, 1985

Related U.S. Application Data

[60] Continuation of Ser. No. 347,247, Feb. 9, 1982, abandoned.

[30] Foreign Application Priority Data

Mar. 4, 1981 [JP] Japan ..... 56-29906

[51] Int. Cl.[4] ..... H01R 43/04

[52] U.S. Cl. ..... 29/882; 29/520; 228/3.1

[58] Field of Search ..... 29/830, 876, 877, 882

[56] References Cited

U.S. PATENT DOCUMENTS

| | | | |
|---|---|---|---|
| 2,646,613 | 7/1953 | Enzler | 29/520 X |
| 2,715,169 | 8/1955 | High | 29/874 X |
| 3,547,334 | 12/1970 | Gwyn, Jr. | 29/882 X |
| 3,686,457 | 8/1972 | Dubac et al. | 29/830 X |
| 4,073,425 | 2/1978 | Bollian | 228/3.1 X |
| 4,259,557 | 3/1981 | Takano | 29/882 X |

FOREIGN PATENT DOCUMENTS

| | | | |
|---|---|---|---|
| 59341 | 9/1982 | European Pat. Off. | 29/882 |
| 567125 | 1/1933 | Fed. Rep. of Germany . | |
| 1208498 | 1/1966 | Fed. Rep. of Germany . | |
| 1928957 | 10/1977 | Fed. Rep. of Germany . | |
| 642779 | 1/1979 | U.S.S.R. | 29/882 |
| 591183 | 8/1947 | United Kingdom . | |

*Primary Examiner*—Carl J. Arbes

*Attorney, Agent, or Firm*—Antonelli, Terry & Wands

[57] ABSTRACT

A method of production of an electric contact including a contact base member of one metal and a contact member of another metal of hardness lower than that of the contact base member joined to the contact member at one end portion thereof, with the method comprising the steps of forming a blind hole at the one end portion of the contact base member and applying pressure simultaneously to the contact base member and the contact member after the contact member is inserted and filled in the blind hole, to thereby cause the metals of the two members undergo plastic deformation to join them together in intimate contact with each other.

8 Claims, 3 Drawing Sheets

METHOD OF PRODUCTING AN ELECTRIC CONTACT

Figure 1:
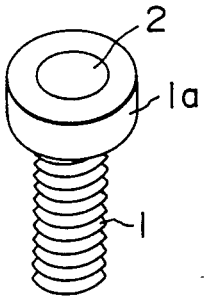

This is a continuation of application Ser. No. 347,247, filed Feb. 9, 1982, now abandoned.

This invention relates to methods of producing electric contacts, and, more particularly, to a method of producing an electric contact formed by joining dissimilar metals together.

Generally, a fixed contact of a magnet switch of, for example, a starter, is formed by joining one end of a rod-shaped contact base member of one metal to a contact member of another metal of good electric conductivity and lower hardness than the metal of the contact base member. In one known production method of a fixed contact of the abovementioned, a contact member is joined, by brazing or welding, to the head of a headed bolt and pressure is applied thereto to shape the same so that a desired contact can be obtained. In another known production method disclosed in West German Pat. Nos. 1,928,957 and Auslegeschrift 1,208,498, a contact base member has a blind hole formed in its head beforehand and a contact member is force fitted into the blind hole to fill same and be secured in place by clamping.

Some disadvantages have been caused in the abovementioned known production. In in the former method, the contact member is joined as by brazing to the contact base member, so that joining can be achieved relatively readily. However, problem arises due to the fact that, by virtue of the heat generated when the two members of dissimilar metals are joined together, the contact member is suffers softening and deterioration, with the result that the contact produced would have its wear resistance reduced when serving in an electric contact.

In the method disclosed in the German references which calls for forcing the contact member into the blind hole formed in the contact base member to fill same and securing same in place by clamping, when the two members are clamped to each other, they are merely in contact with each other locally and tend to peel off when the residual stress produced by the application of pressure is removed, thereby causing a gap to be formed therebetween. When the product of these methods is used as a contact, the residual stress would be reduced with time as heating and cooling are repeated in cycle with passing of a current and blocking thereof while in service, so that the two members would separate from each other and a gap would be formed therebetween. Also, the shape of the blind hole does not essentially undergo changes, and consequently, the two members would be clamped together while the metal oxide film formed on the surface prior to clamping exists without being removed therefrom. The presence of such metal oxide film would interfere with the conductivity between the two metals. Moreover, since the contact is formed of dissimilar metals, the two members of dissimilar metals would have different coefficients of thermal expansion. Thus, when the two members are secured in place by clamping it, it would be impossible to obtain a sufficiently high bond strength to keep them together for a prolonged period of time because a reduction in residual stress occurring with time and the presence of the oxide at the interface would make it impossible to bring them into contact and perfectly fix them in place. Thus, slip would occur at the interface due to the difference in the coefficient of thermal expansion between the two members as passing of a current and blocking same as repeatedly effected, so that the two members would undergo deformation and the development of the gap between them would be promoted. When the gap has attained a certain magnitude, the contact would fail to perform its essential function satisfactorily because spark discharge would occur at the interface between the two members when current is passed through the contact. Such contact would be unsatisfactory for specifications and orders, because the product would lose reliability in performance.

This invention has one of its objects the provision of a method of producing a contact by utilizing plastic deformation of metals occurring when pressure is applied thereto to obtain an electric contact of high joint strength.

Another object is to provide a method of producing an electric contact by utilizing plastic deformation of metals occurring when pressure is applied thereto to obtain an electric contact of high joint strength and good conductivity between two members of dissimilar metals.

In accordance with the present invention a method for producing an electric contact is provided wherein a contact base member of one metal and a contact member of another metal of a hardness lower than that of the contact base member is united to one surface of the contact base member, with the method including forming a blind hole at one surface of the contact base member and then forcibly fitting the contact member, of substantially the same volume as the blind hole into the blind hole to fill same, with further pressure being applied to the two members in an axial direction of the blind hole to cause the two members to simultaneously undergo plastic deformation thereby bringing the two members into intimate contact with each other and integrating them together with high joint strength.

Figure 2A:
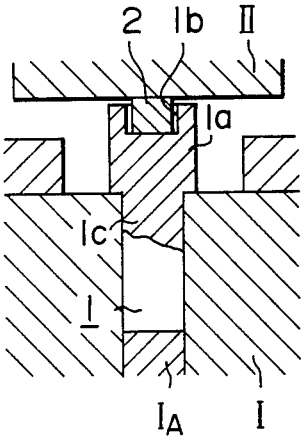
Figure 2B:
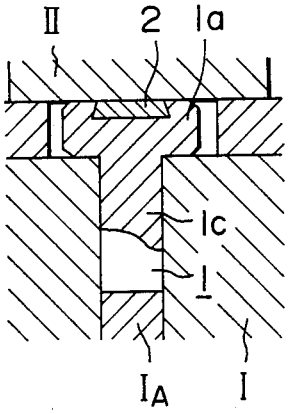
Figure 3A:
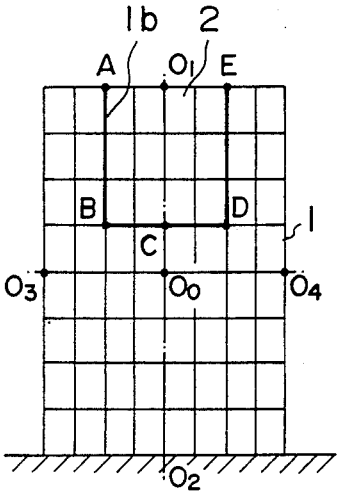
Figure 3B:
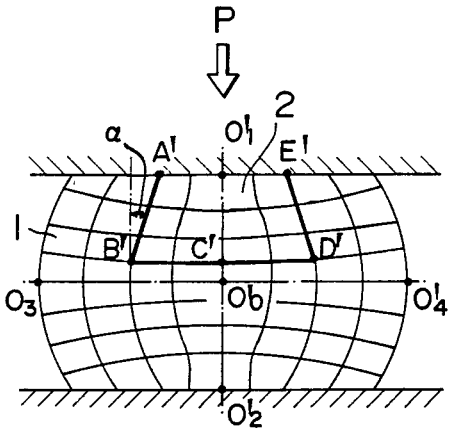
Figure 4:
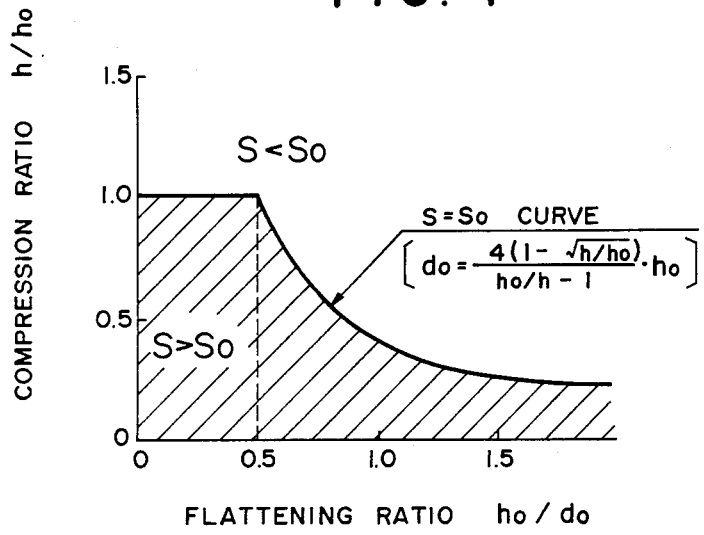

FIG. 1 is a perspective view of an electric contact produced by the method according to the invention;

FIGS. 2*a* and 2*b* are cross-sectional views illustrating the manner in which the contact member is joined to the contact base member, according to a first method of production the present invention;

FIGS. 3*a* and 3*b* are graphical illustrations of the conditions the metals undergo during a plastic deformation;

FIG. 4 is a graph showing the compressibility-flattenability characteristic of the metals shown in FIGS. 3*a* and 3*b;*

Figure 5A:
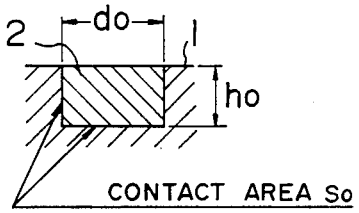
Figure 5B:
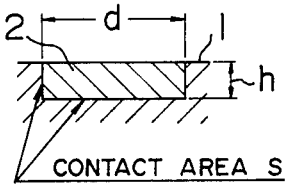
Figure 6A:
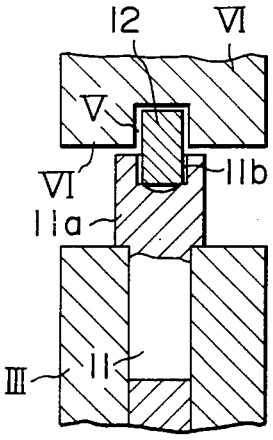
Figure 6B:
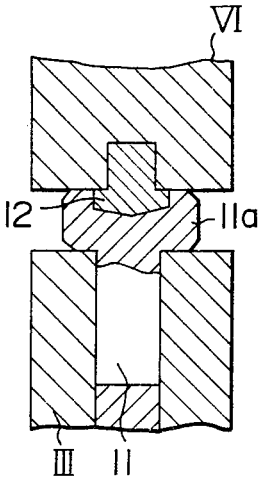
Figure 6C:
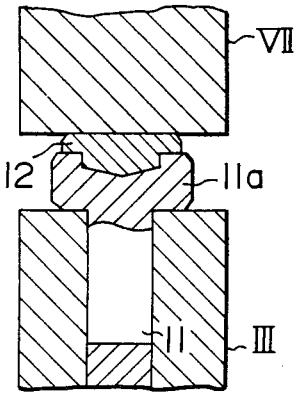

FIGS. 5*a* and 5*b* are cross sectional views showing the relation between the contact area of the contact base member and the contact area of the contact member before and after plastic compression deformation as shown in FIGS. 2*a* and 2*b;* and FIGS. 6*a* and 6*b* and 6*c* are cross-sectional views illustrating the process steps followed in joining the contact member to the contact base member in a second method of the present invention.

Referring now to the drawings wherein like reference numerals are used throughout the various views to designate like parts and, more particularly, to FIG. 1 according to this figure a fixed contact of a magnet switch for a starter includes a contact base member 1 formed of one metal, for example soft iron of relatively low hardness in the form of a rod, with the base member 1 being provided with a head 1*a* having intimately attached thereto a contact member 2 formed of a good conductor metal, such as, for example, copper.

As shown in FIG. 2*a*, a cylindrical blind hole 1*b* of about, for example, 6 mm in diameter and about 3 mm in depth, is formed in the contact base member 1 to extend from the upper surface of the head 1*a* inwardly thereof, with the contact base member 1 then being placed on a lower die I in such a manner that the underside of the head 1*a* is in contact with the upper surface of the lower die I, so that the contact base member 1 is positioned with a rod-shaped portion 1*c* thereof of about, for example, 7 mm in diameter and about 24 mm in height, being held in position between lower dies I and $I_A$. The head 1*a* is, for example, about 9 mm in diameter and about 6.5 mm in height. The contact member 2 of, for example, about 3.3 to 3.4 mm in height and substantially the same volume as the blind hole 1*b* is inserted in the blind hole 1*b* with a clearance of less than, for example, about 0.2 mm between the inner wall surface of the hole 1*b* and the outer periphery of the contact member 2. Thus, the contact member 2 projects outwardly of the surface of the head 1*a* by about 0.3 to 0.4 mm.

An upper die II, shown in FIG. 2*a*, is gradually moved downwardly, to first cause the blind hole 1*b* to be filled with the contact member 2 and then to compress the head 1*a* as shown in FIG. 2*b* as the upper die II is further moved downwardly. Thus, both members 1 and 2 expand radially and undergo plastic deformation in such a manner that the contact member 2 is enveloped by the contact base member 1, whereby, the contact base member 1 is shaped into a trapezoidal form of substantially the same height and the surface of the contact member 2 and the surface of the contact base member 1 adjacent each other are flush with each other. As shown in FIG. 3*a*, graduated to show the deformation conditions caused by metal flow upon compression of the contact member 2 (copper) inserted in the blind hole 1*b* formed at one end of the contact base member 1 (soft iron), by applying pressure thereto from above, the metals undergo deformation as shown in FIG. 3*b*. More specifically, a vertical axis extending through a metal center point $O_o$ is expanded in the form of a drum with a line 0'1–1–0'2 in the center. This condition is brought about by the fact that the coefficient of friction f between the tools (upper and lower dies) for compressing the metals and the metals to be compressed cannot be f=0 in actual practice.

Thus, it will be appreciated that as pressure is applied to the members 1 and 2 in the axial direction, an elongation occurring at a contact surface A'–E' between the metals and the dies is smaller in magnitude than an elongation occurring at a boundary B'–C'–D' between the contact base member 1 and the contact member 2, and that the contact member 2 shows a maximum elongation at points B' and D' while contact surfaces A'–B' and D'–E' taper, following completion of compression, Also, the compressive force exerted on the contact member 2 tends to expand the blind hole 1*b* of the contact base member 1 and the compressive force exerted on the contact base member 1 tends to compress the contact member 2 in the blind hole 1*b*, so that stresses jostling each other are produced at the boundary between the two metals of the contact base member 1 and the contact member 2. Thus, no gap is formed between the two members 1 and 2 which undergo plastic deformation and flow smoothly as if they were integral, so that the two members 1, 2 are joined together with the stresses being uniformly distributed in the contact interface between them. In the method described in the West German references noted above, only the contact member is deformed to achieve the integration. However, in the method according to the invention, pressure is applied to both the contact base member 1 and the contact member 2 to compress same to cause them to undergo plastic deformation, so that the two metals behave as if they were a fluid when they are subjected to plastic deformation.

FIG. 4 provides an illustration of the area of contact interface (boundary) between the contact member 2 and the contact base member 1 before and after plastic compression shown in FIGS. 3-*a* and 3-*b* more particulary FIG. 4 shows the relation between the flattening ratio (height $h_o$ before compression/diameter $d_o$ before compression) and the compression ratio (height h after compression/height $h_o$ before compression) of the contact member 2 and the area of contact interface between the contact base member 1 and the contact member 2 before and after compression.

In FIGS. 5-*a* and 5-*b*, the relation between flattening ratio and compression ratio in which the area of contact $S_o$ shown in FIG. 3-*a* before compression and the area of contact S after compression become equal to each other is represented by an $S=S_o$ curve in FIG. 4. It will be seen that in the region above the $S=S_o$ curve the area of contact interface decreases or $S<S_o$ after compression and in the region below the $S=S_o$ curve the area of contact interface increases or $S>S_o$ after compression.

Thus, in the invention, it is possible to select a flattening ratio that suits the condition of use in the range of the region of $S>S_o$ shown in FIG. 4 so as to decide on the compression ratio to be relied on. Optimally the compression and flattening ratios can be about 0.6 and 0.5, respectively. When the two members 1 and 2 were subjected to plastic compression by meeting the aforesaid requirements, they showed an increase in the area of contact of about 10% and the angle of inclination $\alpha$ of the axial interface between the contact base member 1 and the contact member 2 with respect to the axis was about 16 degrees.

Thus, there is obtained a freshly created interface which conforms to $\Delta S=S-S_o$, wherein $S_o$ is the initial contact area covered by inclusions such as an oxide film etc., with S being the contact area after plastic compression, so that the contact member 2 is united to the contact base member 1 in clean metal-to-metal contact. This eliminates the disadvantages of the prior art that the presence of the metal oxide film and other foreign matter in the interface causes a marked reduction in voltage and a marked increase in contact resistance, thereby increasing the conductivity of the contact.

In the embodiment shown and described hereinabove, the blind hole 1*b* has a flat bottom. However, by shaping the bottom substantially in the form of a bowl, it is possible to increase the area of contact interface between the two members 1 and 2, to thereby increase the density per unit area of the current in the center of the bottom of the contact member 2 which is united with high joint strength to the contact base member 1. Thus, the contact obtained optimally suits the condition of use.

The blind hole 1*b* formed in the contact base member 1 has been shown and described as being cylindrical in shape. However, it is to be understood that the invention is not limited to this specific form of the blind hole 1*b* and that a polygonal shape may be selected for the blind hole 1*b* in a case where turning moment is applied to the contact. The shape of the blind hole 1*b* is selected depending on the use to which the contact is put. As shown in FIGS. 6*a*–6*c*, a contact base member 11 includes a head 11*a* formed at one end with a blind hole 11*b* of substantially the same dimensions as the blind hole 11*b* of the first embodiment but having a bottom of the bowl shape having fitted therein with a contact member 12 of, for example, a height of about 6.5 mm and a volume larger than the volume of the blind hole 11*b*. A lower die III is of the same shape as that described in the first embodiment, but an upper die IV is formed, at a pressing surface VI thereof, with a recess V of a volume equal to the volume of the excess material of the contact member 12 which equals a value subtracting the volume of the hole 11*b* from the volume of the contact member 12.

When the two members 11 and 12 are compressed and their metals undergo plastic deformation with the same compression ratio and flattening ratio as those described with reference to the first embodiment, they are brought to intimate contact with and united to each other on the same principles described by referring to the first embodiment. In this embodiment, the excess material of the contact member 12 fills the recess V of the upper die IV. When further pressed by an upper die VII having a planar pressing surface as shown in FIG. 6*c*, the excess material thereof is extended on the surface of the head of the contact base 11, to thereby provide a large surface area of contact member 12. The contact produced by the method of this embodiment not only has high joint strength between the two members 11, 12 of dissimilar metals but also has a large surface area at the surface of the contact member 12, so that it suits the condition of use.

From the foregoing description, it will be appreciated that by the method of production according to the invention, it is possible to provide an electric contact in which a contact base member and a contact member of dissimilar materials can be joined together with high joint strength.

What is claimed is:

1. A method of producing an electric contact, the method comprising the steps of:

providing a contact base member of one metal, which base member has an axially extending blind hole;

providing a contact member of another metal of hardness lower than a hardness of the contact base member which contact member has a columnar shaped portion insertable into the blind hole and a height greater than a depth of the blind hole;

inserting the contact member into the blind hole of said contact base member;

applying axial pressure to the contact member to fill the blind hole with the contact member, an intimate contact interface area being formed between the contact member and a whole portion of the blind hole; and applying axial pressure subsequent to the filling of the blind hole of the contact base member with the contact member, plastically axially compression-deforming both the contact member and the contact base member simultaneously, increasing, by the simultaneous plastic compression deformation of both said contact member and said contact base member, said initial intimate contact interface area into a final contact interface area larger than said initial contact interface area while changing an axial sectional shape of the interface defined between a wall of the blind hole and the contact member into a trapezoidal shape with the smallest side of the shape being the side adjoining said contact member, wherein an electrically superior contact state as well as a firm mechanical engagement between the contact member and the contact base member is achieved.

2. A method of production of an electric contact including a contact base member of one metal and a contact member of another metal of hardness lower than a hardness of the contact base member united to the contact base member at one end portion, thereof, the method comprising the steps of:

preparing the contact base member shaped to have a head and a rod portion extending from said head;

forming a blind hole of a predetermined volume in the head of said control base member along a center axis of said contact base member;

preparing the contact member shaped to have a columnar portion insertable in said blind hole and projecting outwardly of said blind hole and above the head when inserted in the blind hole;

inserting the contact member into the blind hole of the contact base member;

holding the underside of the head of the contact base member and the rod portion thereof by lower dies; and applying axial pressure to the contact member to plastically deform the contact member to fill the blind hole with the contact member; and applying axial pressure subsequent to the filling of the blind hole of the contact base member with the contact member so as to plastically axially-compression deform the contact member and contact base member simultaneously thereby increasing by the simultaneous plastic compression-deformation of both of said contact member and said contact base member an initial intimate contact interface area into a final contact interface area larger than said initial contact interface area while changing an axial sectional shape of the interfce defined between a wall of the blind hole and the contact member into a trapezoidal shape with the smallest side of said shape being the side adjoining said contact member, whereby an electrically superior contacting state as well as a firm mechanical engagement between the contact member and the contact base member is achieved.

3. A method of production as claimed in one of claims 1 or 2, wherein the blind hole formed in the contact base member has a bottom substantially in the form of a bowl.

4. A method of production as claimed in claim 3, wherein a compression ratio of the plastic deformation and a flattening ratio of the contact member are selected in such a manner that an area of contact interface between the contact member and the contact base member becomes greater after the plastic deformation has occurred than before the plastic deformation.

5. A method of production as claimed in one of claims 1 or 2, wherein the metal of said contact base member in iron and the metal of said contact member is copper.

6. A method of production as claimed in claim 4, wherein said compression ratio is about 0.6 and the flattening ratio of said contact member is about 0.5.

7. A method of production as claimed in one of claims 1 or 2, wherein the contact member joined to the contact base member in intimate contact with each other has a free surface which is flush with the free surface of the contact base member adjacent thereto.

8. A method of producing an electric contact including a contact base member of one metal and a contact member of another metal of a hardness lower than that of the contact base member joined to the contact base member at one end portion thereof, the method comprising the steps of:

preparing the contact base member shaped have a head and rod portion extending from said head;

forming a blind hole of a predetermined volume in the head of said contact base member along a center axis of said contact member;

preparing the contact member insertable in said blind hole having a portion extending outwardly of the blind hole above the head by a predetermined volume when inserting in the blind hole;

holding an underside of the head of the contact member and the rod portion thereof by lower dies;

inserting the contact member in the blind hole and then applying pressure simultaneously to the two metals axially of the blind hole by an upper die formed with a recess for accommodating a projection of the contact member, said recess being essentially of the same volume as said projection, to plastically deform the contact member to fill the blind hole while the projection of the contact member extends in a predetermined proportion from the head; and applying axial pressure subsequent to the filling of the blind hole so as to cause the projection of the contact member extending from the head and the contact base member to further undergo plastic deformation at the same time so that an initial intimate contact in interface area between the contact base member and the contact member is changed into a final contact interface area greater than the initial intimate contact interface area while changing an axial sectional shape of the interface defined between the wall of the blind hole and the contact member into a trapezoidal shape with the smallest side of said shape being the side adjoining the contact member, whereby an electrically superior contact state as well as a firm mechanical engagement between the contact member and the contact base member is achieved.

* * * * *